US006257037B1

(12) United States Patent
Lonero et al.

(10) Patent No.: US 6,257,037 B1
(45) Date of Patent: Jul. 10, 2001

(54) DEEP ROLLING TOOL MECHANISM WITH NOVEL SPRING CONTAINING CAGE DESIGN

(75) Inventors: Vincent J. Lonero, Bloomfield Hills; Shawn D. Luteran, Waterford, both of MI (US)

(73) Assignee: Lonero Engineering Co., Inc., Troy, MI (US)

( * ) Notice: Subject to any disclaimer, the term of this patent is extended or adjusted under 35 U.S.C. 154(b) by 0 days.

(21) Appl. No.: 09/563,123

(22) Filed: May 2, 2000

(51) Int. Cl.[7] ..... B21H 7/18
(52) U.S. Cl. ..... 72/110
(58) Field of Search ..... 72/107, 110; 29/6.01

(56) References Cited

U.S. PATENT DOCUMENTS 5,575,167 * 11/1996 Gottschalk et al. ..... 72/110
6,094,956 * 8/2000 Vodopyanov et al. ..... 72/110

* cited by examiner

*Primary Examiner*—Lowell A. Larson
(74) *Attorney, Agent, or Firm*—Dinnin & Dunn P.C.

(57) ABSTRACT

An upper work tool mechanism for use in deep rolling operations and having a housing and a cover plate, as well as a cage system for operatively mounting the work rollers, with the cage being designed such that the cage and the cage retainer members have one or more uniquely positioned springs associated therewith to support the cage.

16 Claims, 3 Drawing Sheets

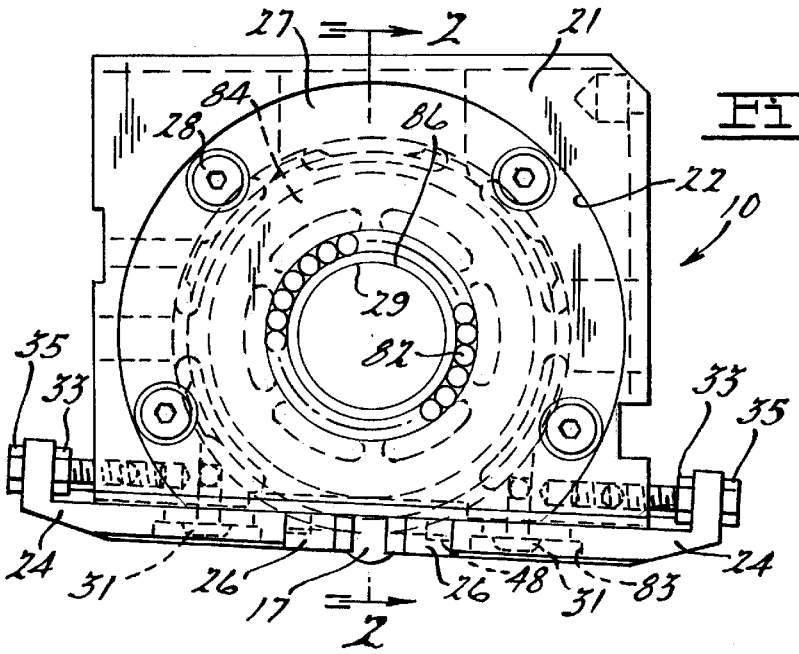
Fig. 1.
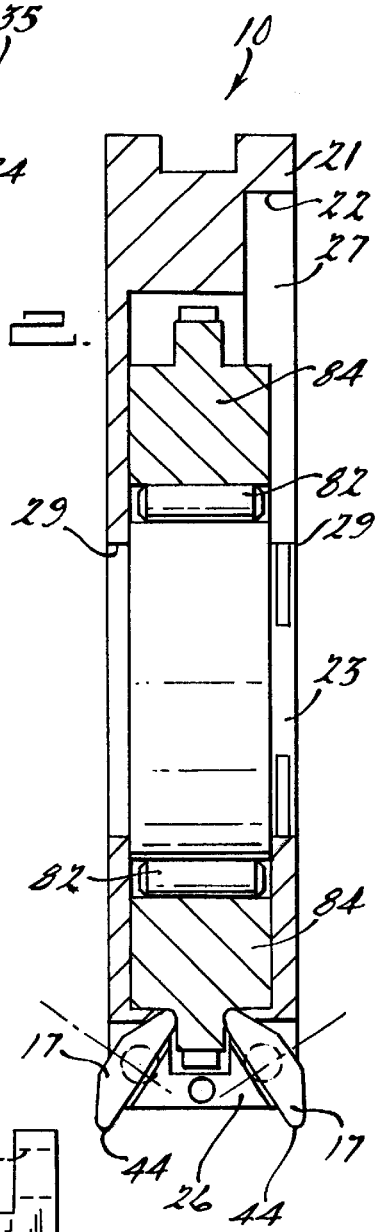
Fig. 2.
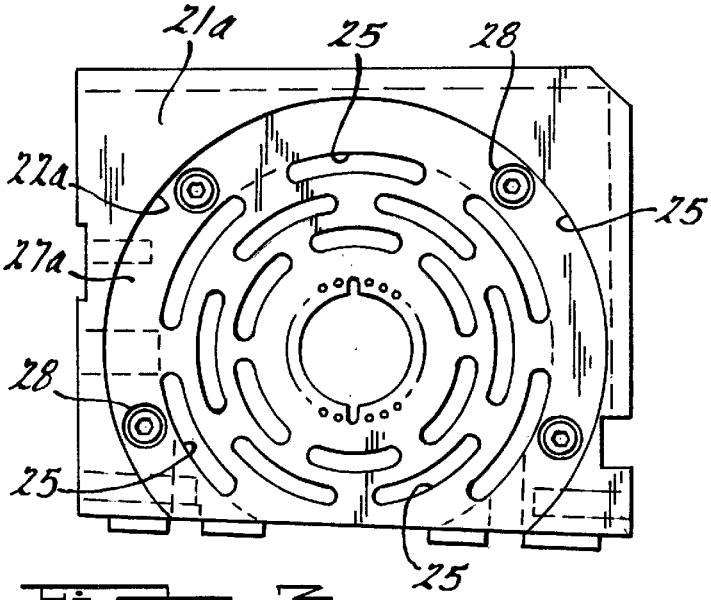
Fig. 3.
Fig. 5.
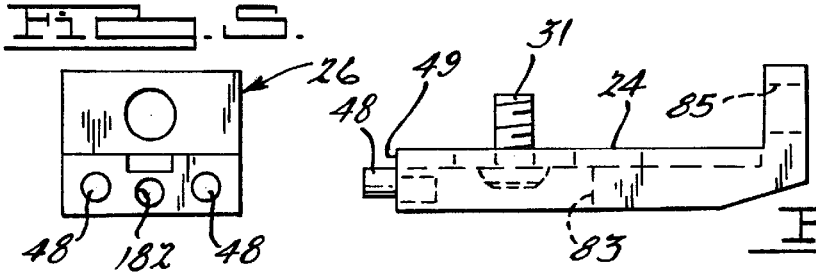
Fig. 4.

DEEP ROLLING TOOL MECHANISM WITH NOVEL SPRING CONTAINING CAGE DESIGN

BACKGROUND OF THE INVENTION

This invention broadly relates to deep rolling fillets for engine crankshafts or other annular areas of metallic work pieces subject to high stress loads. More particularly, this invention relates to a new tool mechanism for deep rolling machines, wherein the tool mechanism includes a new and unique cage and retainer design for holding the work rollers.

The state-of-the-art is indicated by the following cited references: Gottschalk, U.S. Pat. No. 5,495,738; Gottschalk, et al. U.S. Pat. No. 5,445,003; Bone, U.S. Pat. No. 5,493,761; Winkens, U.S. Pat. No. 5,138,859; Berstein, U.S. Pat. No. 4,561,276; and Ostertag, U.S. Pat. No. 4,947,668. The disclosures of Lonero, et al. U.S. Pat. No. 5,699,692 and Lonero, et al. U.S. Pat. No. 5,806,184 are hereby incorporated herein by reference.

Various machines and methods have been employed to strengthen and finish metal work pieces such as crankshafts and camshafts for internal combustion engines. In many modern automobiles, engines have been downsized for installation into small vehicles. Accordingly, with downsizing of automotive vehicles and their components for reducing weight and improving fuel efficiency, smaller engines and crankshafts are often used. To improve the fatigue strength and durability of these crankshafts, deep rolling of fillets and other circular joint areas is increasingly important. The fatigue strength and durability of crank pins and main bearing journals can be significantly increased by deep rolling compressive stresses into the middle of the annular fillets between the pin journals and adjacent counter weights or balancing webs.

In previously designed tool mechanisms for deep rolling machines the cage members which hold the working rollers during the deep rolling operation are subjected to significant wear and tear. These cage members are usually made of bronze, and during the rolling operation a certain clearance is introduced to the cage members to permit proper rotation of the rollers themselves. Since the rolling operation occurs basically in one rotational direction only, the cage members also tend to wear down. As this wearing action occurs on the cage members, a gap (or excessive clearance) begins to occur or build up. This excessive clearance or gap eventually leads to improper functioning of the deep rolling tool. Those working in the art have long sought a solution to this problem.

Accordingly, one object of the present invention is to provide a novel design for a tool mechanism used in deep rolling operations wherein the cage and retainer structure for the tool mechanism is of a new and unique design.

Another object of the present invention is to provide a new and improved tool mechanism for deep rolling operations wherein the cage and retainer design for the tool includes the novel use of a special spring loaded cage structure.

Still another object of the present invention is to provide a newly designed tool mechanism for deep rolling operations which has an improved and unique cage and retainer design for holding the work rollers, and which also is designed such that the tool mechanism can be cleaned in conventional ultrasonic cleaning systems without disassembly.

Other objects features and advantages of the present invention will become apparent from the subsequent description and the appended claims, taken in conjunction with the accompanying drawings (wherein like numerals indicate like elements).

BRIEF DESCRIPTION OF THE DRAWINGS

FIG. 1 is a side view of an upper work roller tool used for deep rolling of a crankshaft;

FIG. 2 is a sectional view taken along the line 2—2 in FIG. 1;

FIG. 3 is an alternate embodiment of the invention, and in general is a view of just the housing portion of FIG. 1, with numerous apertures positioned through the housing;

FIG. 4 is a side view of the cage retainer member shown in tool shown in FIG. 1;

FIG. 5 is a left side view of FIG. 4;

SUMMARY OF THE INVENTION

Figure 6:
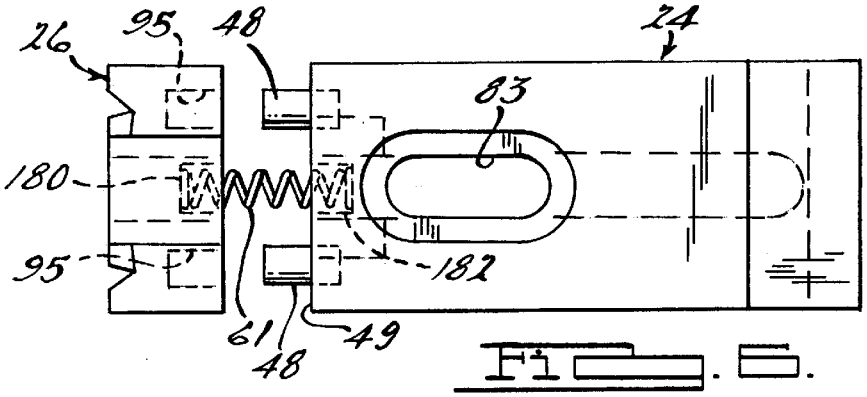
FIG. 6 is an expanded view of the cage member and cage retainer member of FIG. 1 in accordance with the invention.
Figure 7:
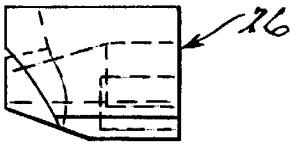
FIG. 7 is a view of just the cage member from FIG. 1.
Figure 8:
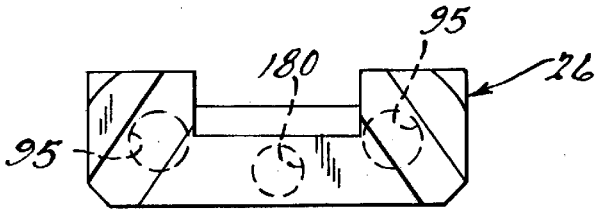
FIG. 8 is a side view of FIG. 7 taken from the right side thereof.
Figure 9:
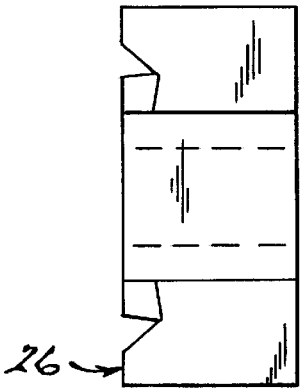
FIG. 9 is a bottom view of the cage member shown in FIG. 7.

Briefly stated, this invention involves a tool mechanism for use in the deep rolling of a crankshaft or like product, comprising: a housing having a side forming an annular opening, a cage formed by cage members and cage retainer members at one end of said housing, work rollers operatively mounted in the cage and operatively inclined outward to physically engage a fillet of said product, at least one annular cover plate secured to said housing at said annular opening, and with the cage structure including at least one spring member mounted relative to an aligned aperture located proximate to the outer side of the cage member and an adjacent side of said cage retainer member.

The technical advantage of this spring loaded cage design uniquely enables the cage member of the deep rolling tool to be biased in a direction toward the work rollers, and therefore, any gaps or excess clearances (which occur due to wear and tear of the rolling operation) are reduced and/or eliminated.

DISCRIPTION OF THE PREFERRED EMBODIMENTS AND BEST MODE OF CARRYING OUT THE INVENTION

Referring now in greater detail to the drawings, FIG. 1 is a sectional view of an upper work roller tool 10 which is used to engage and roll the journal area of a crankshaft (not shown). FIG. 2 is a cross-sectional view of work roller tool 10 to show the interior construction in more detail. The tool 10 comprises a rectangular main housing or body 21 that has been formed to provide an annular recess 22 that receives an annular cover plate 27. The cover plate 27 is secured to the main body 21 by threaded fasteners 28. The main body 21 and cover plate 27 have enlarged recesses 29 to receive a cylindrical hub 23.

The work roller tool 10 has a pair of L-shaped cage retainer members 24 (to be discussed in more detail hereinafter), which cage retainer members are adjustably secured to the lower end of the main body 21 by opposing adjustable threaded fasteners 35. The retainer members 24 also utilize threaded fasteners 31 (see FIGS. 1 and 4) to adjust and maintain the proper positioning of the cage retainer members 24. The retainer member 24 can be slidably positioned inwardly or outwardly from cage members 26 by sliding movement of the fastener 31 in the slot 83 (see FIGS. 1 and 4) The fasteners 35 also utilize lock nuts 33 to lock fastener 35 in fixed position. The retainers 24 have inboard ends 49 for engagement with and to give support for cage members 26, 26 which form the actual cage to support the two rollers 17, 17.

When the retainers 24 are secured to the main body 21, the cage members 26 support the work rollers 16 for floating rotation generally upwardly and outwardly to an inclined axis 42 (see FIG. 2) so that the working circumference 44 of the work rollers 17 extend and engage the annular fillets of the crankshaft (not shown) being rolled.

The tool mechanism 10 also includes threaded screws 28 which hold the cover plate in position and needle bearings 82 which support and enable rotational movement of a backup roll 84. The tool mechanism further includes anti-rotation pin 86.

The work roller tool 10 shown in FIGS. 1, 2 and 4–9 is now further described as one embodiment of the invention. FIGS. 4–9 illustrate the cage retainer member 24 and cage member 26 which are utilized in the work roller tool 10 of FIGS. 1 and 2. The cage retainer member 24 and its accompanying cage member 26 are of a unique design which includes two pin members 48. Pin members 48 are fixedly positioned within the cage retainer member 24 by any suitable means, such as threading, welding, adhesive, or the like. However, the pins 48 also slidably fit into the aligned apertures 95 on the cage member 26. The cage retainer member 24 and its associated cage member 26 (as best seen in the slightly expanded view of FIG. 6) have a corresponding spring member 61 positioned therebetween, and held within holes 180 and 182. While FIG. 6 is shown in expanded view format, it will be recognized that when the two members are positioned closely together in the work roller tool 10 of FIG. 1, the spring 61 will be compressed but will have a force or biasing direction (to the left as shown in FIG. 6). This biasing force by the spring 61 will cause the cage member 26 to take up any excess clearance or gap which might occur through the wearing action caused by constant rotation of the rollers 17 during the rolling operation.

As seen in FIGS. 1 and 2 (and also in FIGS. 4–6) the tool mechanism 10 includes two dowels or pins designated 48 which extends from the cage retainer member 24 into the adjacent cage member 26. The purpose of the dowels or pins is to provide a sliding support for small movements of the cage member 26 into and away from the rollers 17; and also, to assist in maintaining proper location of the cage member 26 when the cage member is biased or forced inwardly by the spring member 61 when any gap or clearance occurs due to wear and tear on the cage member 26 caused by the constant rolling movement of the rollers 17. This enables proper support and functioning of the two work rollers 17, 17 to carry out the deep rolling action.

Thus, the unique purpose and action carried out by the spring member 61 causes it to press the cage member 26 toward the left (as viewed in FIG. 6) whenever a gap occurs, and thus the corresponding cage member 26 on each side of the rollers 17, 17, will carry out the purpose of causing the cage members to be pressed inwardly a sufficient amount to close any gap or excess clearance that might occur during the rolling operation. It should also be understood that the spring loading of the cage member 26 can be carried out on only one side (e.g., the right side of rollers 17 in FIG. 1), or it can be carried out simultaneously on both the right and left sides. This applies to all embodiments shown herein.

FIG. 3 shows another embodiment of the invention, where the housing body 21*a* and the cover plate 27*a* have numerous openings or apertures 25 positioned completely through both the housing and the cover plate, to thereby facilitate lubrication and cleaning of the tool mechanism.

Figure 10:
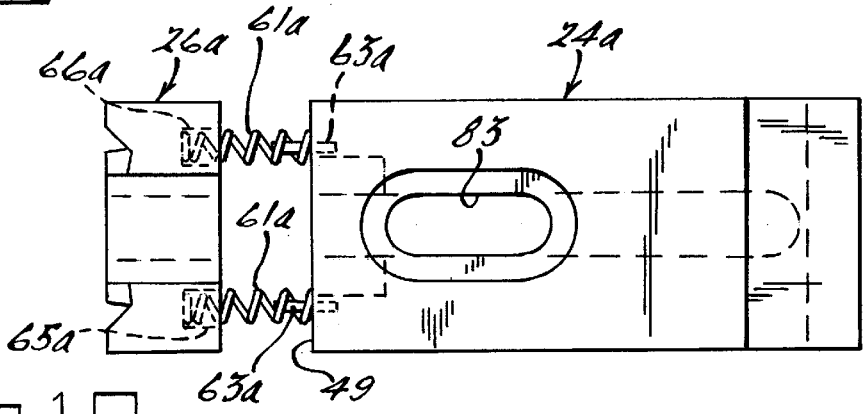
FIG. 10 is a view of an alternate embodiment of a cage member and cage retainer member in accordance with the invention.

FIG. 10 shows an alternate embodiment of the invention wherein the cage retainer member designated 24*a* is associated with a cage member 26*a*. In this embodiment of FIG. 10 two spring members designated 61*a* are positioned on small pin members 63*a* appropriately located and positioned within the retainer 24*a*. The purpose of the pin members 63*a* is to assist in positioning and holding the concentrically located spring members 61*a*. The opposite end of the spring members 61*a* are positioned within aligned apertures 65*a* and 66*a* which apertures 65*a*, 66*a*, act to properly locate and hold the spring members 61*a*. As shown in the embodiment of FIG. 10 (expanded view) when the cage retainer 24*a* and 26*a* are positioned into a tool mechanism 10 of the type shown FIG. 1, the retainer 24*a* and cage member 26*a* will be positioned closely together with the springs 61*a*, 63*a* acting to bias or push the cage members 26*a* in a direction towards the center of the work rollers 17, 17. This biasing action by the springs 61*a*, 63*a* will act to uniquely close up or take away any gap or excessive clearance that occurs between the work rollers 17 and the cage members 26*a*.

Figure 11:
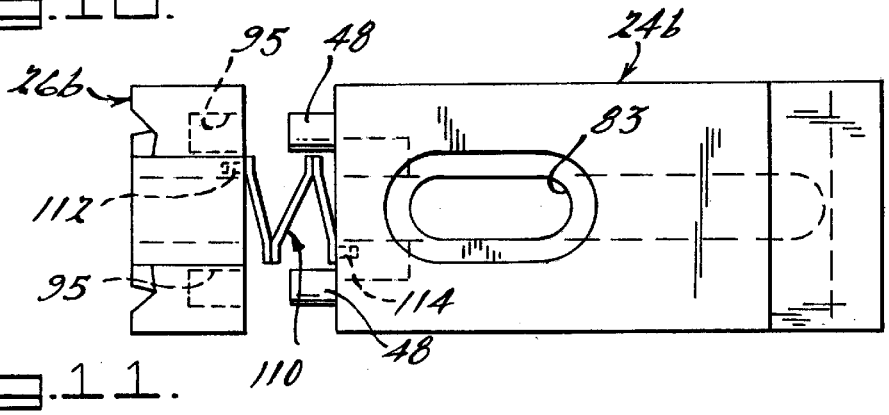
FIG. 11 is a view of still another alternate embodiment of the invention.

FIG. 11 shows still another embodiment of the invention, and in this embodiment the cage retainer member 24*b* and cage member 26*b* cooperate in such a fashion that the pin members 48 again act to assist with the positioning and proper location of the cage member 26*b* when the pin members are slidably positioned within the receptive holes 95 drilled or bored in the cage member 26*b*. However, in the embodiment of FIG. 11 a leaf spring member designated 110 is positioned between the cage retainer member 24*b* and cage member 26*b*. The leaf spring 110 is held in proper position by small pin members 112 and 114 positioned at each end of the leaf spring 110. These small pins 112 and 114 are fixed within small apertures in the members 26*b* and 24*b* respectively, to anchor and support the proper positioning of the leaf spring 110. When the embodiment of FIG. 11 is positioned within a work roller tool 10 as shown in FIG. 1, the cage retainer 24*b* and 26*b* will be closely positioned together, however, the leaf spring 110 will act to bias the cage member toward the center of the work roller 17, 17, and thereby again act to uniquely close up or take away any gap or excessive clearance that occurs in the cage members due to the wear and tear caused by the constant rolling action of the work rollers 17, 17.

Figure 12:
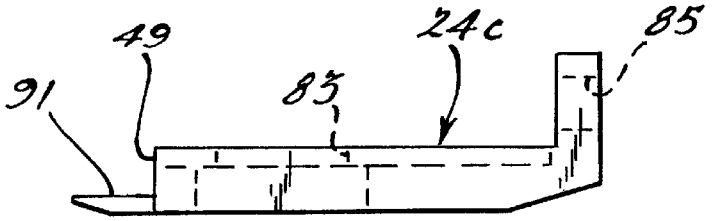
FIG. 12 is a view of cage retainer member in accordance with still another alternate embodiment of the invention.
Figure 14:
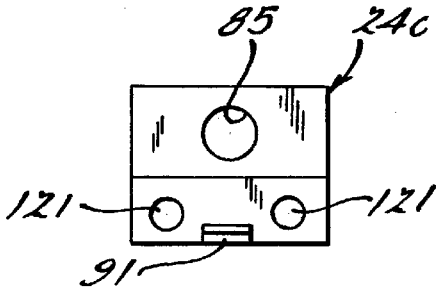
FIG. 14 is a side view of FIG. 12.
Figure 13:
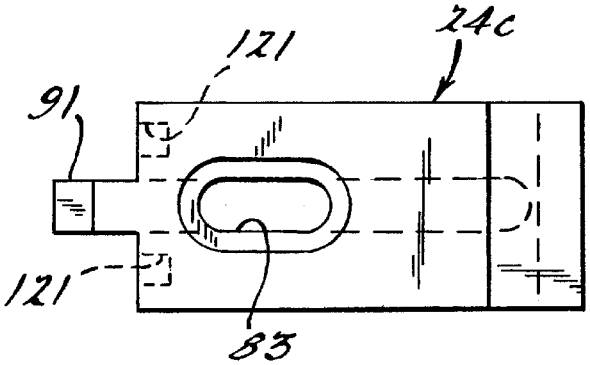
FIG. 13 is a bottom view of FIG. 12.
Figure 15:
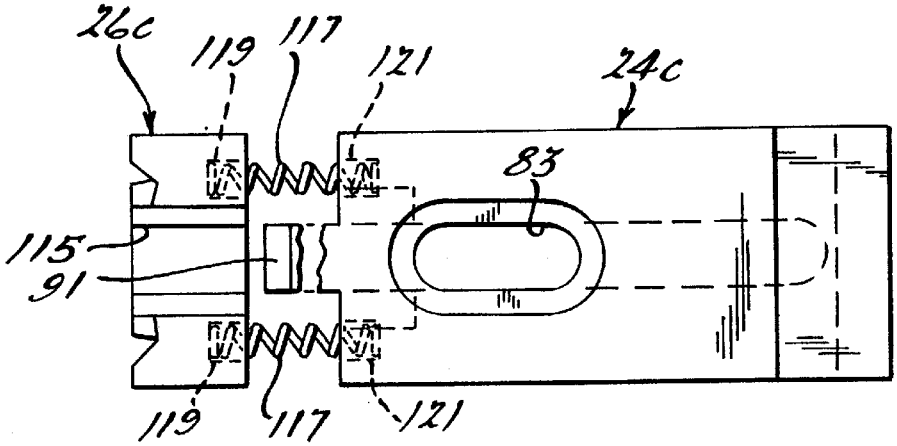
FIG. 15 is an expanded view showing the relationship between the cage retainer member of FIG. 12 as it would be positioned relative to a cooperating cage member in accordance with the invention.

FIGS. 12–15 illustrate another embodiment of the invention. FIGS. 12, 13 and 14 show a cage retainer member 24*c* which can be utilized in the tool mechanism 10 of FIG. 1. In the cage retainer member 24*c* it will be observed that there is a tab member 91 positioned off the end of the retainer member 24*c* and this tab member 91 fits into and supports the cage member 26*c* by sliding engagement with the slot 115 shown in FIG. 15. The retainer member 24*c* and cage member 26*c* as shown in FIG. 15 also includes two spring members designated 117. These spring members are housed within small apertures or holes designated 119 in the cage member 26*c* and holes 121 shown in the retainer member 24*c*. These holes 119 and 121 act to properly locate and position the spring members 117. While the view shown in FIG. 15 is in slightly expanded form, it will be recognized that when the retainer 24*c* and cage member 26*c* are used in the tool mechanism 10 of FIG. 1, the cage member 26*c* and cage retainer 24*c* will be more tightly compressed together (as shown by the numerals 24 and 26 in FIG. 1). However, as any gap or clearance occurs due to the wearing action caused by the constant rotation of the work rollers 17, 17, the two spring members 117 shown in FIG. 15 will cause the cage members 26*c* to be biased or moved in a direction toward the rollers to thereby take up and close any gap or clearance which might occur.

The unique technical advantage and purpose of the spring members, shown for example in FIGS. 6, 10, 11, and 15, is to provide unique support and proper location for the cage members 26 used in tool mechanism 10. The spring members carrying out this technical advantage by biasing the cage members 26 to a proper location which surrounds the work rollers 17, 17 during the deep rolling operation. And as mentioned previously, when any gap or clearance occurs due to the significant wear and tear which occurs during long usage of the work rollers 17, 17, the spring members will act to close up or remove the gap or clearance from the tool mechanism. This novel and unique purpose for the spring members overcomes long standing problems in the field of work roller tools used in the deep rolling of crankshafts and like products.

While it will be apparent that the preferred embodiments of the invention disclosed are well calculated to fulfill the benefits, objects, and/or advantages of the invention, it will be appreciated that the invention is susceptible to modification, variation and change without departing from the proper scope or fair meaning of the subjoined claims.

What is claimed is:

1. A tool mechanism for use in the deep rolling of a crankshaft product or like product, comprising:

a) a housing having a side forming an annular opening, b) a cage formed at one end of said housing, c) work rollers operatively mounted in said cage and operatively inclined outward to physically engage a fillet of said product, d) at least one annular cover plate secured to said housing at said annular opening, e) at least one cage retainer member slidably positioned on said housing and engaging an outer side of said cage away from said rollers, f) at least one spring member mounted relative to an aligned aperture and with the spring member being located between the outer side of said cage and an adjacent side of said cage retainer member.

2. The tool mechanism of claim 1 wherein, said cage is formed of two opposing cage members, each having said outer side, and two cage retainer members each of which are closely proximate to an outer side of said cage members, and there being a plurality of said spring members mounted in said apertures.

3. The tool mechanism of claim 2 wherein, said housing contains a plurality of openings therein to facilitate cleaning and lubrication of the tool mechanism.

4. The tool mechanism of claim 1 wherein, said housing contains a plurality of openings therein to facilitate cleaning and lubrication of the tool mechanism.

5. The tool mechanism of claim 4 wherein, said annular cover plate contains a plurality of openings therein.

6. The tool mechanism of claim 1 wherein, said cage is formed of two opposing cage members, each having said outer side, and two cage retainer members each of which are closely proximate to an outer side of said cage members, and there being at least one pin member mounted in one or more apertures located proximate to an adjacent cage member and cage retainer member.

7. The tool mechanism of claim 6 wherein, said housing contains a plurality of openings therein to facilitate cleaning and lubrication of the tool mechanism, and said annular cover plate contains a plurality of openings therein.

8. A tool mechanism for use in the deep rolling of a crankshaft product or like product, comprising:

a) a housing having a side forming an annular opening, b) a cage formed at one end of said housing, c) work rollers operatively mounted in said cage and operatively inclined outward to physically engage a fillet of said product, d) at least one annular cover plate secured to said housing at said annular opening, e) at least one cage retainer member slidably positioned on said housing and engaging an outer side of said cage away from said rollers, f) said cage retainer member having a tab member at one end thereof, with said tab member protruding into and engaging an outer side of said cage, g) at least one spring member mounted between an outer side of said cage and an adjacent side of said cage retainer member.

9. The tool mechanism of claim 8 wherein, said cage is formed of two opposing cage members, each having said outer side, and two cage retainer members each of which engage an outer side of said cage members, and there being a plurality of said spring members between an adjacent cage member and cage retainer member.

10. The tool mechanism of claim 9 wherein, said housing contains a plurality of openings therein to facilitate cleaning and lubrication of the tool mechanism, and said annular cover plate contains a plurality of openings therein.

11. A tool mechanism for use in the deep rolling of a crankshaft product or like product, comprising:

a) a housing having a side forming an annular opening, b) two cage members at one end of said housing, c) work rollers operatively mounted in said cage members and operatively inclined outward to physically engage a fillet of said product, d) at least one annular cover plate secured to said housing at said annular opening, e) two cage retainer members positioned on said housing and engaging opposing outer sides of said cage members away from said rollers, f) a plurality of spring members mounted proximate to the outer sides of each cage member and an adjacent side of each said cage retainer member.

12. The tool mechanism of claim 11 wherein, the two cage members each have an outer side, at least one pin member mounted in an aligned aperture located proximate to an adjacent cage member and cage retainer member.

13. The tool mechanism of claim 12 wherein, said housing contains a plurality of openings therein to facilitate cleaning and lubrication of the tool mechanism.

14. The tool mechanism of claim 13 wherein, said annular cover plate contains a plurality of openings therein.

15. The tool mechanism of claim 11 wherein, said housing contains a plurality of openings therein to facilitate cleaning and lubrication of the tool mechanism.

16. The tool mechanism of claim 15 wherein, said annular cover plate contains a plurality of openings therein.

* * * * *